US006863495B2

(12) United States Patent
Halliwell et al.

(10) Patent No.: US 6,863,495 B2
(45) Date of Patent: Mar. 8, 2005

(54) GAS TURBINE BLADE TIP CLEARANCE CONTROL STRUCTURE

(75) Inventors: Mark A Halliwell, Derby (GB); Henry Tubbs, Tetbury (GB)

(73) Assignee: Rolls-Royce plc, London (GB)

( * ) Notice: Subject to any disclaimer, the term of this patent is extended or adjusted under 35 U.S.C. 154(b) by 16 days.

(21) Appl. No.: 10/412,299

(22) Filed: Apr. 14, 2003

(65) Prior Publication Data

US 2004/0018084 A1 Jan. 29, 2004

(30) Foreign Application Priority Data

May 10, 2002 (GB) ..... 0210674

(51) Int. Cl.[7] ..... F01D 11/08

(52) U.S. Cl. ..... 415/173.1; 415/173.3; 415/176

(58) Field of Search ..... 415/173.1, 173.2, 415/173.4, 175, 176, 178, 116, 173.3

(56) References Cited

U.S. PATENT DOCUMENTS

| | | | | |
|---|---|---|---|---|
| 3,824,031 A | | 7/1974 | Gilbert | |
| 3,975,901 A | * | 8/1976 | Hallinger et al. | 60/786 |
| 4,565,492 A | | 1/1986 | Bart et al. | |
| 5,044,881 A | * | 9/1991 | Dodd et al. | 415/173.3 |
| 5,154,578 A | | 10/1992 | Miraucourt et al. | |

FOREIGN PATENT DOCUMENTS

| | | |
|---|---|---|
| EP | 0808991 A2 | 11/1997 |
| EP | 0808991 A3 | 12/1997 |
| EP | 0952309 A2 | 10/1999 |
| EP | 0952309 A3 | 11/2000 |
| GB | 2062117 | 5/1981 |

* cited by examiner

*Primary Examiner*—F. Daniel Lopez
*Assistant Examiner*—Dwayne J. White
(74) *Attorney, Agent, or Firm*—W. Warren Taltavull; Manelli Denison & Selter PLLC

(57) ABSTRACT

A turbine blade tip clearance control system has a rigid two part outer casing (42) which sandwiches a control ring (48) therebetween, and an air pressurised flexible inner casing (28) which carries shroud segments (22) within it. Struts (40) span the annular space between the casings (42, 28) and prevent flexing of casing (28) until blade tip clearance needs adjusting, whereupon, ring (48) is heated, along with the adjacent portion of outer casing (42) and expands, allowing casing (28) to flex outwards, thus lifting the shroud segments (22) away from the blade tips (24).

Closure of the tip clearance is achieved by cooling ring (48), the resulting contraction thereof, via the struts (40), flexing the inner casing (28) and shroud segments (22) inwards, against the air pressure.

6 Claims, 2 Drawing Sheets

GAS TURBINE BLADE TIP CLEARANCE CONTROL STRUCTURE

FIELD OF THE INVENTION

The present invention relates to a structure within which a stage of turbine blades rotates, during operation of an associated gas turbine engine.

More specifically, the structure is of the kind which may be caused to expand and contract along lines radial to the axis of rotation of the stage of turbine blades, so as to at least reduce the magnitude of blade tip rub on structure immediately surrounding them.

BACKGROUND OF THE INVENTION

Devices are known, which are designed to expand radially about a stage of turbine blades, so as to maintain a desirable clearance therebetween. A first example is described and illustrated in published patent specification 1484936. In that example, non rotating shrouds surround a stage of turbine blades. The downstream ends of the shrouds are hooked on a first expandable ring, which is located by radial dowels. The shrouds ends are also hooked in a ring of different expansion and contraction characteristics from those of the first ring. The upstream end of each shroud has an arm fixed thereto by one end, the other end having a ball thereon, which pivots in a socket in fixed structure when the first ring expands as a result of being heated, thus enabling, the first ring to lift the shrouds away from the tips of the blades. The other ring prevents too rapid movement of the shrouds towards the tips of the blades when cooling occurs.

A further example is illustrated and described in published patent specification 1605403. A turbine casing surrounds a stage of turbine blades, which again, include spaced, non rotatable shrouds. A polygonal member surrounds the turbine casing, and has radially arranged bolts fixed thereto so as to project radially inwards, towards the shrouds. The bolts heads locate in the opposing ends of expandable segments which surround the shrouds, which segments in turn, are hooked via their centre portions, to the opposing ends of the respective shroud segments. When the expandable segments are heated, they expand about their centres, into arched forms, thus lifting the shroud segments away from the tips of the blades.

Both examples of prior art disclosed hereinbefore rely entirely on expansion, and are comprised of a multiplicity of parts, which are extremely expensive to produce, and results in complexity of assembly. In the former example, there are provided valve mechanisms which themselves must be expanded, so as to enable heat to reach the shroud moving mechanism. In the latter example, accurate movement of the blade shroud segments about the pivot point of their respective arms, raises the need for, possibly, undesirably large clearances between their downstream extremities and structure adjacent thereto, and thus would reduce turbine efficiency through gas leakage.

SUMMARY OF THE INVENTION

The present invention seeks to provide an improved gas turbine blade tip clearance control structure.

According to the present invention, a gas turbine engine turbine blade tip clearance control system comprises a rigid outer casing connectable to a variable temperature air supply, a flexible inner casing having an inner surface connectable to a pressurised air supply, and supporting a circumferential array of shroud segments therewithin, an equi-angular array of struts separating said casings, whereby, in operation in a gas turbine engine, said outer casing is expandable and contractable by application of hot or cold air thereto, to allow or prevent, via said struts, pressurised air acting on said inner casing inner surface, to flex said inner casing.

DESCRIPTION OF THE DRAWINGS

The invention will now be described, by way of example, and with reference to the accompanying drawings, in which.

DESCRIPTION OF THE INVENTION

Figure 1:
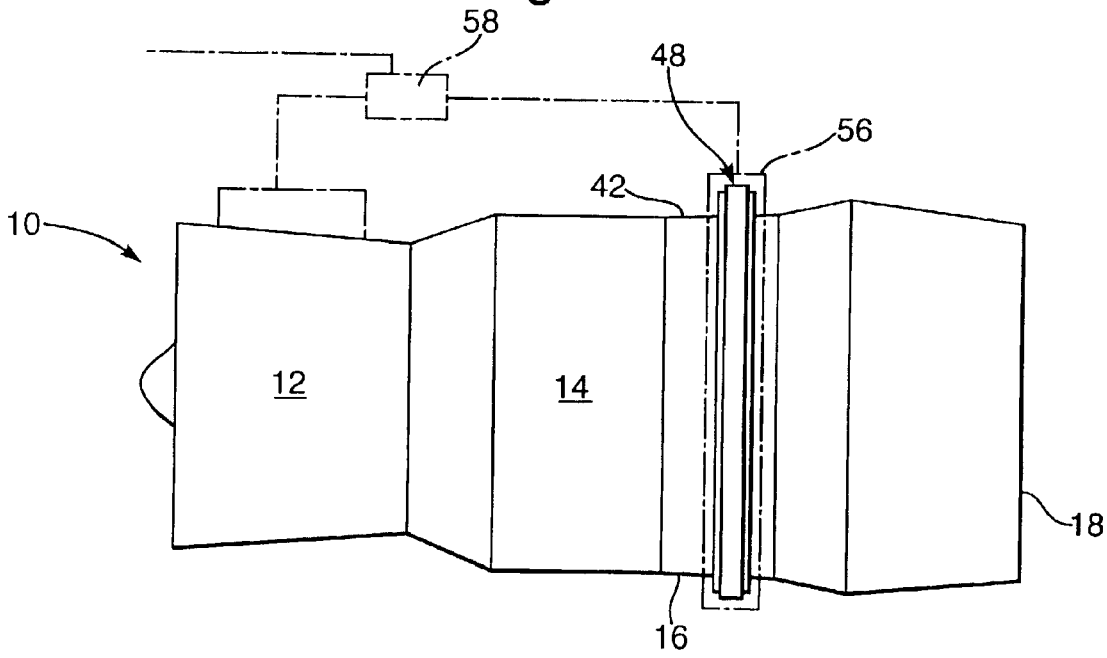
FIG. 1 is a diagrammatic representation of a gas turbine engine incorporating blade tip clearance control structure in accordance with the present invention.

Referring to FIG. 1. A gas turbine engine 10 has a compressor 12, a combustion section 14, a turbine stage 16, and an exhaust nozzle 18, all arranged in flow series in known manner.

Figure 2:
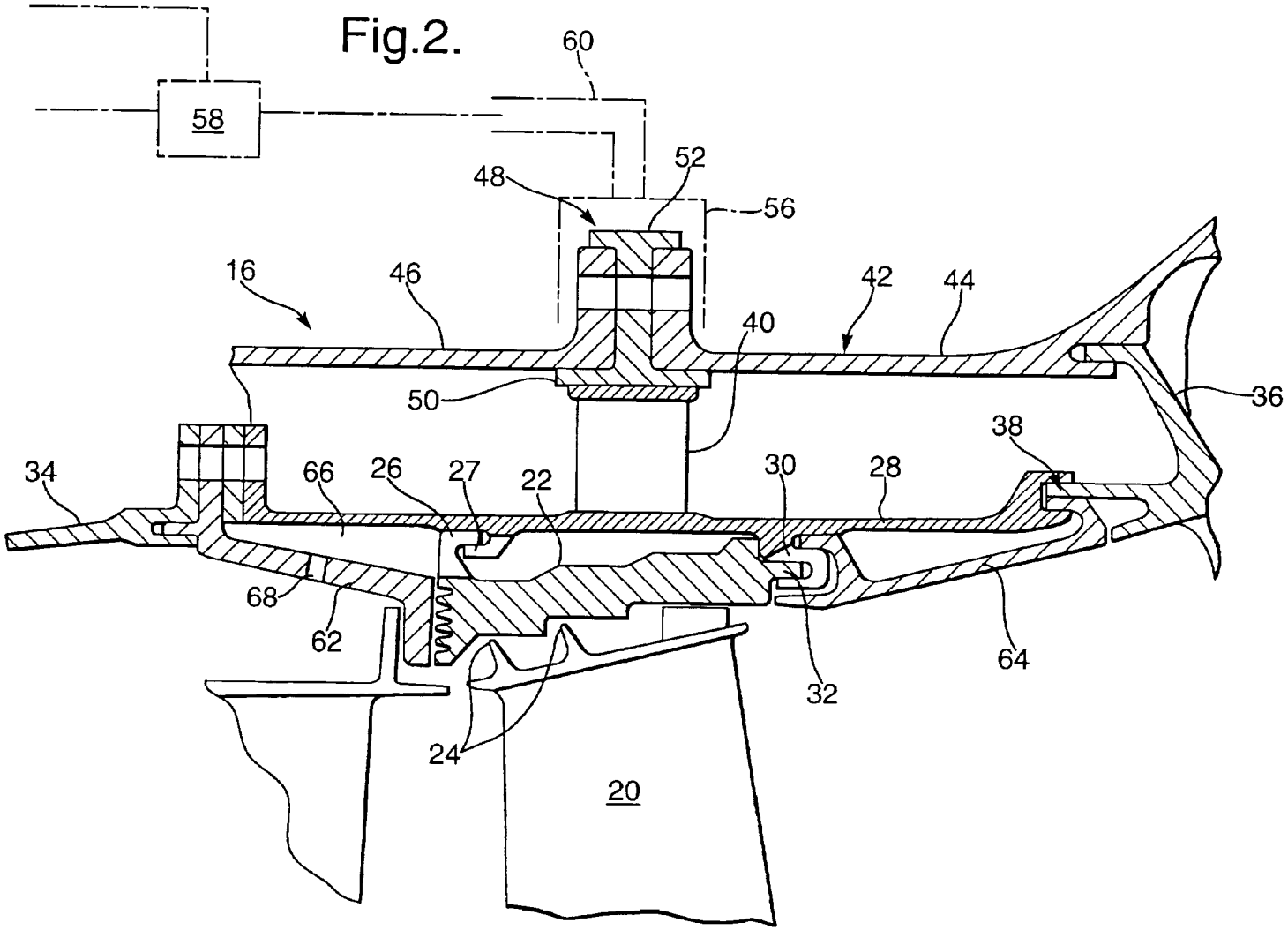
FIG. 2 is an enlarged, cross sectional view of the encircled portion in FIG. 1.

Referring now to FIG. 2. The turbine stage 16 includes a rotary stage of turbine blades 20, only one of which is shown. The stage of blades 20 is surrounded by a ring of shroud segments 22, which, in, a non operative mode of engine 10, are very closely spaced from the tips 24 of respective blades 20. The spacing is achieved by supporting the shroud segments by cooperating hooked features 26 and 27 on their leading edges, and on the interior of a flexible casing 28 and by 'birdmouth' joints 30 on the interior of flexible casing 28, cooperating with spigots 32 on the trailing edges of the shroud segments 22. Although in this particular case a 'birdmouth' joint 30 is employed other fastening devices such as hooks could be employed likewise the spigots 32 could be replaced by an alternative fastening device such as a hook or lip.

Casing 28 is fixed in its upstream end it to further casing structure, 34, which extends towards or over the combustion zone 14. The downstream and of casing 28 is supported on further fixed structure 36, via a sliding 'bird mouth' joint 38, which enables some axial movement thereof, through casing 28 flexing during operation of engine 10. Again, although a 'bird mouth' joint 38 is employed, other suitable joint arrangements which provide the necessary degree of sealing, may be used.

Casing 28 has a number of struts of substantial proportions projecting radially therefrom, in equi-angularly spaced array, the outer ends of which indirectly abut the inner surface of a rigid, low flexibility outer casing 42, thereby supporting casing 28 against flexing under air pressure loads and mechanical generated during operation of engine 10.

During at least some operating conditions of engine 10, blades 20 will expanded radially outwards, and shroud segments 22, must also be moved outwards, so as to eliminate or at least minimize rubbing of the blades tips 24 against them. To this end it, casing 28, is made from a material, which is of such proportions, and is a sufficiently flexible, as to enable it to achieve the desired adequate movement. However, because struts 40 are present, that circumferential portion of rigid casing 42, which surrounds struts 40 must also be movable. In a radially outward direction, which is explained later in this specification. The relevant portion of casing 42 is made up from two axially short casings. 44 and 46, which are fixedly joined via flanges, which sandwich a ring 48 therebetween. Ring 48 has an inner land 50 and an outer land 52, which overlap in their respective interfaces with the casings 44 and 46.

A thin segmented ring 54 is positioned between the inner land 50 and the struts 40, and acts as a thrust load distributor, when radial loads are experienced by struts 40 and ring 48, as is explained hereinafter.

Prior to start up of engine 10, casing 28 holds shroud segments 22 in close spaced relationship with the blades tips 24. When engine 10 is started, and runs at idle speed, there is insufficient growth of turbine blades 20, to require flexing of casing 28, to cause movement of shroud segments 22 away from blades 20. However, when an aircraft (not shown), driven by engine 10, takes off, engine 10 is accelerated it to full thrust, at which time, its operating temperature rapidly increases, and, consequentially, so does growth of blades 20. It then becomes necessary to flex casing 28, to move shroud segments 22, so as to at least reduce rubbing of blade tips 24 against them.

As stated hereinbefore, in order that casing 28 may flex radially outwards of the axis of engine 10, the portion of rigid outer casing 42 which is in radial alignment with struts 40 must be caused to move in the same direction. This is achieved by heating the flanged joint and ring 48 which is sandwiched therebetween. A cowl structure 56 is provided, which surrounds the flanged joint and ring 48, and hot air derived from an appropriate region of the compressor 12 is directed thereto via a control valve 58, and a conduit 60. The flanged joint and ring 48 then expand, and thus enable struts 40, and casing 28 to follow, without losing contact therewith.

Flexing of casing 28 is achieved as follows. Shroud 30 segments 22, with respective casings 28, 62 and 64, form an annular space 66, which, via a circumferential array of apertures 68, only one of which is shown, is in permanent flow communication with a high pressure stage in the compressor 12. As the pressure of the air delivered from compressor 12 increases during the aforementioned aircraft take off stage, it reaches a level within space 66, at which together with thermal distortion of the casing 28 it forces casing 28 to start flexing in a radially outward v direction. Shroud segments 22 are thus lifted away from blade tips 24.

When engine 10 is throttled back, as occurs when the aircraft is required to fly at cruise speeds, compressor delivery pressure will reduce, and casing 28 will begin to flex radially inwards, to the points where it attains not quite its original cold shape. This provides an appropriate spacing between shroud segments 22 and blade tips 24.

In order that ring 48, via segmented ring 54, maintains or subsequently resumes its indirect contact with struts 40 when casing 28 flexes or has flexed radially inwards, ring 48 and associated flanges must be cooled, so as to cause them to contract at a rate which will ensure constant contact therebetween. This is achieved by directing air from the upstream, low pressure, low temperature portion of compressor 12, via valve 58, into cowl 56, thus enveloping ring 48 and associated flanges therewith.

The appropriate actuation of valve 58, in order to match flexing of casing 28, and expansion of ring 48 and associated flanges, with blade tip clearance during varying engine running conditions, may be achieved in a number of ways, including developing electronic signals from any engine measurable operating parameters, such as engine revolutions, engine pressures, and engine air and/or gas pressures, and utilising those electronic signals to actuate valve 58, so as to direct air of appropriate temperature, or pressure, to appropriate parts.

Figure 3:
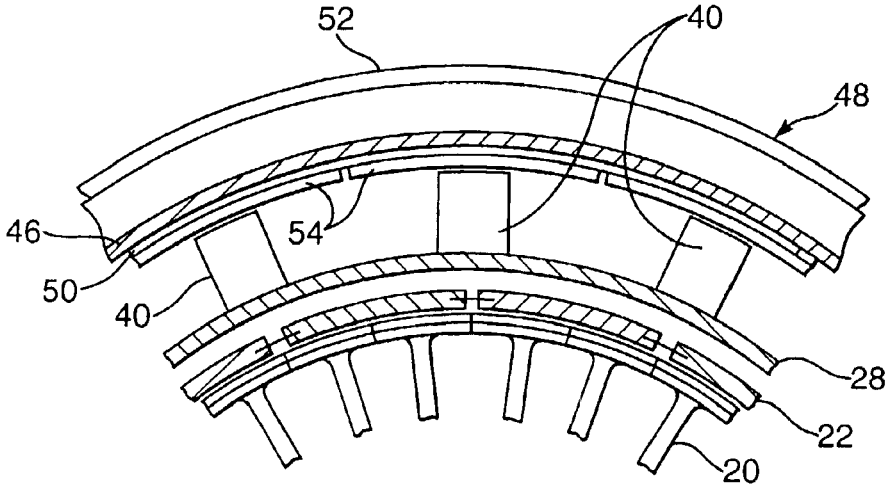
FIG. 3 is a view on line 3—3 of FIG. 2.

Casing 28 is flexed by the application of pressure to its inner surface in combination with mechanical and thermal loads, and is subjected to that pressure through all of the working regimes of engine 10. Therefore, a counter pressure is applied to the outer surface thereof, which, combined with the inherent self supporting stiffness possessed by casing 28, is sufficient to prevent undesirable flexing, anywhere along its length. FIG. 3 illustrates the positional relationship between the struts 40 and the segmented load distribution ring 54, which is seen to be split at mid point 70 between each pair of adjacent struts 40. FIG. 3 also depicts the angular positioning of struts 40 with respect to flexible casing 28.

What is claimed is:

1. A gas turbine engine turbine blade tip clearance control system comprising a rigid outer casing connectable to a variable temperature air supply, a flexible inner casing having an inner surface connectable to a pressurised air supply and supporting a circumferential array of shroud segments therewithin, an equi-angular array of struts separating said casings, whereby, in operation in a gas turbine engine, said outer casing is expandable and contractable by application of one of hot and cold air thereto, to allow or prevent, via said struts, pressurised air acting on said inner casing inner surface, to flex said inner casing as the result of the pressurized air acting separately from any other effects on said inner surface when said gas turbine engine is in operation.

2. A gas turbine engine blade tip clearance control system as claimed in claim 1 wherein said struts are affixed to the outer surface of said inner casing.

3. A gas turbine engine turbine blade tip clearance system comprising a rigid outer casing connectable to a variable temperature air supply, a flexible inner casing having an inner surface connectable to a pressurised air supply and supporting a circumferential array of shroud segments therewithin, an equi-angular array of struts separating said casings, whereby, in operation in a gas turbine engine, said outer casing is expandable and contractable by application of one of hot and cold air thereto, to allow or prevent, via said struts, pressurised air acting on said inner casing inner surface, to flex said inner casing wherein said outer casing comprises a pair of casing members having opposing flanged ends, between which a ring is sandwiched in radial alignment with said struts.

4. A gas turbine engine turbine blade tip clearance control system as claimed in claim 3 wherein said ring has inner and outer lands, which overlap respective interface joints between the said ring and said flanges.

5. A gas turbine engine turbine blade tip clearance control system as claimed in claim 4 including a multi-segmented ring, which is located in between the ends of said struts and the radially inner surface of said inner land, whereby to act as a distributor of loads generated by interaction between said struts and said landed ring during expansion or contraction thereof.

6. A gas turbine engine turbine blade tip clearance control system as claimed in claim 1 wherein said flexible inner casing is combined with further casings respectively upstream and downstream thereof, and with said shroud segments, to define a pressure chamber connectable to said pressurised air supply, so that, on receipt of pressurised air therein, a flexing force is applied to the inner surface of said flexible inner casing.

* * * * *